US007429199B2

(12) United States Patent
Burgess

(10) Patent No.: US 7,429,199 B2
(45) Date of Patent: Sep. 30, 2008

(54) LOW RESISTANCE, LOW INSERTION FORCE ELECTRICAL CONNECTOR

(76) Inventor: James P. Burgess, 1343 Wood Duck Trail, Naples, FL (US) 34108

( * ) Notice: Subject to any disclaimer, the term of this patent is extended or adjusted under 35 U.S.C. 154(b) by 0 days.

(21) Appl. No.: 11/432,650

(22) Filed: May 11, 2006

(65) Prior Publication Data

US 2007/0037456 A1 Feb. 15, 2007

Related U.S. Application Data

(60) Provisional application No. 60/707,622, filed on Aug. 12, 2005.

(51) Int. Cl.
*H01R 13/33* (2006.01)

(52) U.S. Cl. ..... 439/841

(58) Field of Classification Search ..... 439/840–841, 439/268, 264, 259, 843, 66, 86, 690, 825, 439/654

See application file for complete search history.

(56) References Cited

U.S. PATENT DOCUMENTS

| | | | | |
|---|---|---|---|---|
| 2,427,001 | A | | 9/1947 | Hubbell et al. |
| 4,033,654 | A | | 7/1977 | Ross |
| 4,082,399 | A | | 4/1978 | Barkhuff |
| 4,093,337 | A | | 6/1978 | Jacobson et al. |
| 4,441,780 | A | * | 4/1984 | Walters ..... 439/609 |
| 4,475,782 | A | * | 10/1984 | Bartolf ..... 439/43 |
| 4,632,496 | A | | 12/1986 | Williams |
| 4,657,335 | A | | 4/1987 | Koch et al. |
| 4,734,063 | A | | 3/1988 | Koch et al. |
| 4,810,213 | A | | 3/1989 | Chabot |
| 4,874,909 | A | | 10/1989 | Velke, Sr. et al. |
| 5,013,261 | A | | 5/1991 | Seisz et al. |
| 5,042,146 | A | | 8/1991 | Watson |
| 5,076,270 | A | | 12/1991 | Stutz, Jr. |
| 5,154,626 | A | | 10/1992 | Watson |
| 5,439,393 | A | | 8/1995 | Watson |
| 5,628,644 | A | | 5/1997 | Szalay et al. |
| 6,471,555 | B2 | | 10/2002 | Creze et al. |
| 6,517,383 | B2 | | 2/2003 | Watson |
| 6,659,778 | B2 | * | 12/2003 | Li ..... 439/66 |
| 6,895,276 | B2 | * | 5/2005 | Kast et al. ..... 607/37 |
| 6,899,571 | B1 | | 5/2005 | Koch et al. |
| 2001/0018298 | A1 | * | 8/2001 | Nakamura et al. ..... 439/841 |

* cited by examiner

*Primary Examiner*—Edwin A. León
(74) *Attorney, Agent, or Firm*—Gifford Krass Sprinkle Anderson & Citkowski

(57) ABSTRACT

A female electrical terminal is comprised of a contact body which is electrically conductive and at least partially bounds an interior volume. The doubly coiled contact spring is disposed in the interior volume. The spring is configured to have a first coil which defines a first helix having a central axis, and the spring is wound so that the central axis defines a second helix.

14 Claims, 3 Drawing Sheets

LOW RESISTANCE, LOW INSERTION FORCE ELECTRICAL CONNECTOR

RELATED APPLICATION

This application claims priority of U.S. Provisional Patent Application Ser. No. 60/707,622 filed Aug. 12, 2005, entitled "Low Resistance, Low Insertion Force Electrical Connector."

FIELD OF THE INVENTION

This invention relates generally to electrical connectors. More specifically, the invention relates to a female electrical terminal which combines a low insertion force with low electrical resistivity, and hence is capable of carrying high currents.

BACKGROUND OF THE INVENTION

Electrical connectors are employed in a variety of applications for establishing reversible electrical connection between portions of a circuit. In general, electrical connectors should be easy to use, and in that regard it is desirable that the insertion force, which is the measure of the force required to couple portions of a connector together, be low. Also, it is desirable that any connector system does not introduce undue electrical resistance into a circuit. Low electrical resistance is particularly important for electrical terminals designed to carry high currents such as connectors used for electric vehicles, power transmission circuits and the like.

Various terminals have been configured in the prior art to provide for a low insertion force and/or high current carrying capacity. In certain approaches, the prior art has incorporated variously configured resilient members into electrical terminals. These resilient members provide for a positive contact between a female terminal and a male connector inserted thereinto while preserving a relatively high contact area. The contact members are variously configured as leaf springs, coil springs, contact blades and the like. Some such terminals are shown in U.S. Pat. Nos. 4,033,654; 6,471,555; 4,734,063; 5,154,626 and 2,427,001, among others. Despite the wide variety of connector terminals available in the art, there is still a need for a terminal which is configured and operable to provide a very low insertion force and provide for very high current carrying capacities. Furthermore, such terminal should be relatively low in cost and easy to fabricate.

As will be explained in detail hereinbelow, the terminal of the present invention is configured to include a doubly coiled spring which provides a resilient connection to a pin, blade, or other member and further operates to establish multiple contact points and current paths between portions of a circuit joined by the connector. The connector of the present invention is easy to fabricate, simple in construction, and low in cost. In use, it provides for a low resistance, high current carrying connection. These and other advantages of the invention will be apparent from the drawings, discussion and description which follow.

BRIEF DESCRIPTION OF THE INVENTION

Disclosed herein is a female electrical terminal. The terminal includes a contact body which at least partially bounds an interior volume. The terminal further includes a contact spring which is comprised of an electrically conductive material which is wound into a first coil so as to define a first helix having a central axis. At least a portion of the contact spring is wound into a second coil so that the central axis of the spring defines a second helix. This second helix portion is disposed within the contact body. This second helix bounds and defines a volume which is configured to receive a male terminal, such as a pin or blade, therein.

In specific embodiments of the invention, the terminal further includes a retainer which maintains the doubly coiled spring in contact with a contact body. This retainer may comprise a spring member such as a coil spring or a leaf spring.

In specific embodiments, the contact member is a cylindrical member. In certain other instances, the contact spring is fabricated from a metal such as copper, and may comprise a wire having a diameter in the range of 2-10 mil, although it is to be understood that in other instances the wire diameter may be larger or smaller. In yet other specific embodiments, the contact spring is configured such that the first helix defined thereby has a diameter of approximately 0.05 inch.

DETAILED DESCRIPTION OF THE INVENTION

The present invention is directed to a female electrical terminal, as is understood to be a terminal which is configured to receive a pin, blade, or other such projecting connection member. The terminal of the present invention includes a contact body which at least partially bounds and defines an interior volume. As such, the contact body may be configured as a cylindrical can, or it may be of an oval, polygonal, or irregular shape. The terminal of the present invention includes a doubly coiled contact spring which is fabricated from an electrically conductive material such as a metal. The conductive material is wound into a first coil so as to define a first helix which has a central axis. This contact spring is then wound into a second helix, also referred to herein as a corkscrew configuration. This double coiled structure is disposed within the contact body, and natural expansion of the spring serves to facilitate its retention therein. In this manner, the coil spring lines the interior of the contact body and provides a high surface area, resilient, contact member which can receive and retain a male contact member therein.

Figure 1:
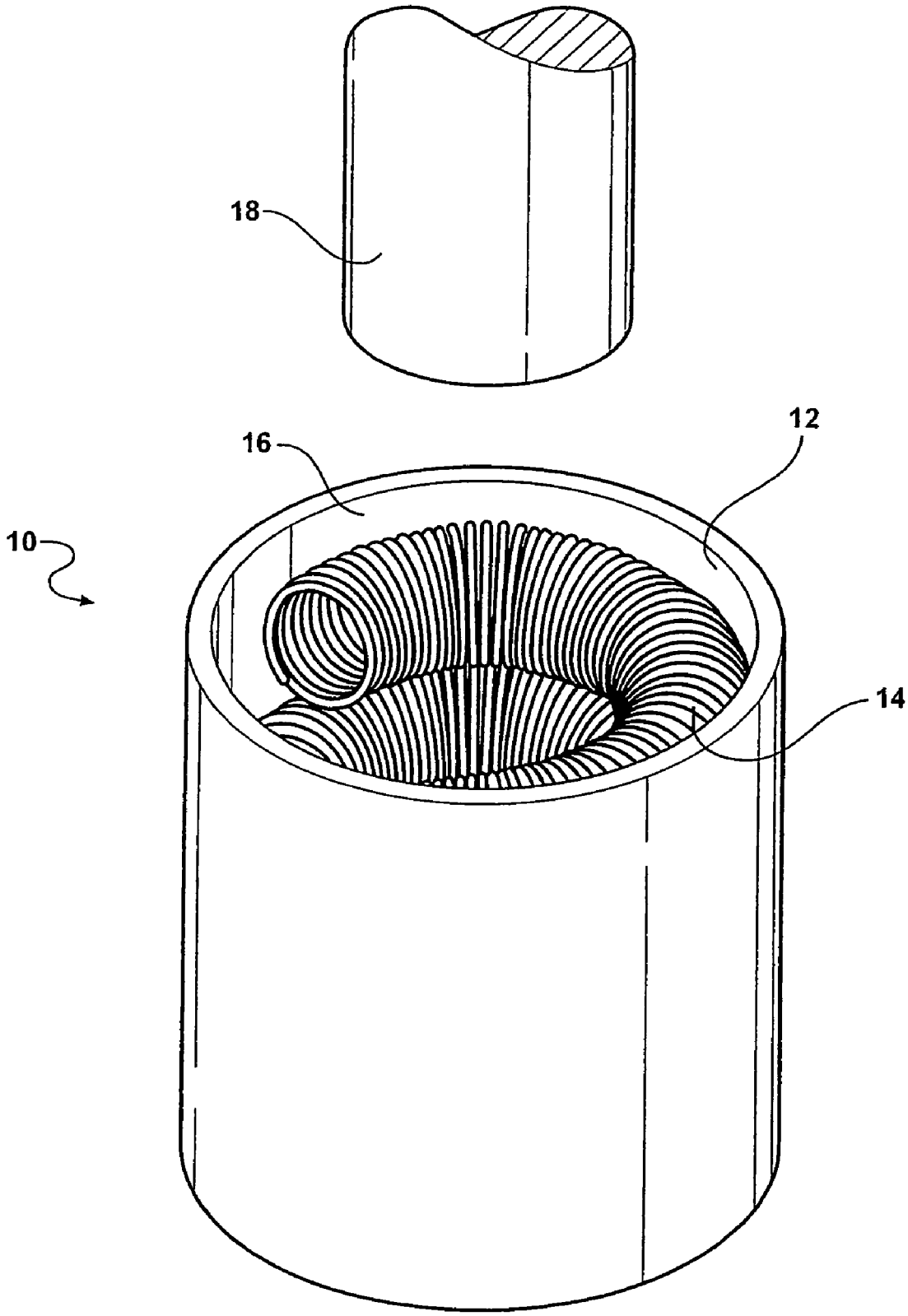
FIG. 1 is a perspective view of a terminal in accord with the present invention.

Referring now to FIG. 1, there is shown a female terminal 10 configured in accord with the principles of the present invention. The terminal 10 includes a contact member 12, which in this instance is a cup shaped, generally cylindrical body. Disposed within the connector body 12 is a coil spring 14. As will be seen, the coil spring is wound into a helical or corkscrew shape and disposed so as to contact an inner wall of the contact body 12. In this manner, the spring 14 lines the wall of the contact body 12 and further defines an interior contact volume 16 configured to receive a male terminal member 18.

Figure 2:
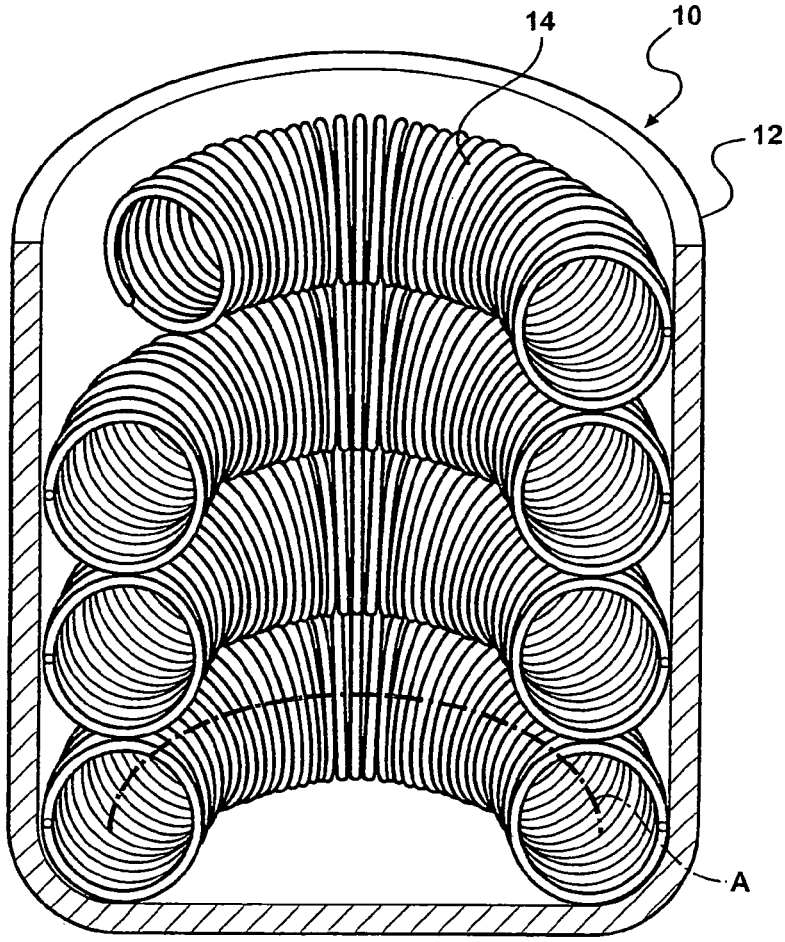
FIG. 2 is a cross-sectional view of the terminal of FIG. 1.

FIG. 2 is a cross-sectional view of a female electrical terminal 10 in accord with the present invention. As will be seen from FIG. 2, the terminal 10 includes a contact member 12, and further includes a contact spring 14 wound thereinto in a helical or corkscrew configuration. As mentioned previously, the contact spring 14 is a coil spring, and in that regard is fabricated from a wire or similar electrically conductive material wound into a first helical coil, said first helix defining a central axis shown herein in part by dotted line A-A. As will be seen, the contact spring 14 lines at least a portion of the interior surface of the contact body 12. This spring provides multiple contact points between the wall of the contact body 12 and a terminal 10 or the like inserted thereinto. Furthermore, the flexible nature of the spring provides for a tight, resilient fit, while still allowing for ease of insertion. The multiple current paths allow the connector to carry high current and/or high voltage. The configuration of the terminal makes it self-cleaning, since insertion of a pin contact will create a wiping action which cleans the terminal and the coil. Furthermore, the open nature of the contact allows for ready circulation of air or other cooling fluids therebetween.

The exact configuration and materials used in the connectors of the present invention will depend upon particular applications. It will be appreciated that, since the coil is resilient, the contact body may be non-resilient, and this feature greatly increases the configurations and utility of the connectors of the present invention. In general, the contact body 12 will be fabricated, at least in part, from a material having good electrical conductivity, and as such may comprise a body of metal, such as copper, aluminum, or the like, or it may comprise a composite of a metal and a polymer, ceramic, or other such material. In some instances, the contact body may incorporate a heat shrinkable plastic sleeve, band, or other such member which may be shrunk into place so as to retain the spring in electrical communication with an electrically conductive portion of the contact body. For example, the shrinkable member may comprise a sleeve which surrounds, and projects slightly beyond, a cylindrical contact body holding a spring. When shrunk, this material will partially cover an open end of the contact body and thereby retain the spring. Although not illustrated, it is to be understood that the contact body will typically include members allowing the terminal to be connected to a portion of a circuit; such members, as is known in the art, may include crimp members, screw connections, solder connections, braze connections, and the like.

Although not illustrated, the contact body may be crimped, bent, or otherwise configured so as to mechanically interlock the contact spring thereto after insertion. Also, it is to be understood that while the contact body is shown herein as being a cylindrical member, it may be of oval configuration, polygonal configuration, or irregular configuration, depending on particular usages. For example, the contact body may be elongated into an ellipsoid or slotted shape so as to be configured to receive a blade terminal. Likewise, it may be configured to receive hexagonal terminals, square terminals and the like. In fact, it is a notable feature of the present invention that the terminal will readily receive and make contact with variously shaped and sized male terminals; hence, the need for utilizing precisely shaped terminal pins is avoided.

While the contact member has been shown as being a cylindrical member, it may be otherwise configured. For example, the contact member may be configured to be implemented with any open volume defined in a body of material, such as an opening in a terminal block, circuit board or the like. In those instances where the material defining the opening is electrically resistive, a body of electrically conductive material will be placed in the opening so as to at least partially bound the volume defined thereby and to establish electrical contact with the spring.

The spring 14 will typically be fabricated from a material having good electrical conductivity such as a metal, and in specific instances, the spring may be fabricated from copper-based alloys which combine good electrical conductivity with high hardness and/or resiliency. Such alloys are known to those of skill in the art and include beryllium copper alloys, bronzes, brasses and the like.

Specific dimensions of terminals of the present invention will depend on particular applications; hence, a wide variety of connectors may be fabricated in accord with the present invention. In general, the connectors will be configured so that insertion of the male member does not permanently deform the coil, although elastic deformations of the coil diameter ranging up to one-third to one-half may be routinely employed. In specific embodiments the primary diameter of the coil which is ultimately wound into the helix will be in the range of 10-30% of the diameter of the contact body, in those instances where the contact body is cylindrical (similar ratios may be employed for non-cylindrical bodies). In typical applications, the connector will be further configured so that the male terminal inserted therein will have a diameter which is one to two times that of the primary diameter of the coil. In this manner, a relatively snug fit will be achieved without causing permanent deformation of the coil. It is to be understood that the foregoing ratios are illustrative of particular embodiments. Other ratios may be employed depending on particular applications and/or on particular materials which are utilized.

In one particular embodiment, the contact spring may be fabricated from a wire having a diameter in the range of 2-10 mils, which wire is wound into a coil of approximately 0.05 inches in diameter. This will produce a spring having about 50-100 coils per running inch in those instances where the spring has a closed coil configuration; in those instances where an open coil configuration is utilized, the number of coils per inch will be smaller. In embodiments of this type, the female terminal may consist of a cylinder having a diameter of about 0.2 inches and a length somewhat in excess of 0.22 inches. In this embodiment, approximately 2 inches of the contact spring are fit into the cylinder and this will produce approximately 4 complete coils of the double coiled 0.05 inch diameter spring inside the cylinder. This will produce an opening in the cylinder which is somewhat less than 0.1 inches configured to receive a corresponding male pin in an interference fit. Clearly, dimensions may be increased or decreased for particular applications. For example, applications for electrical vehicles will use connectors of a much larger size, while microelectronic applications may utilize smaller connectors. Variously configured springs may be used as the contact member of the present invention. However, in specific embodiments springs having a substantially closed coil structure have been found to be particularly advantageous. In the context of this disclosure, a closed coil structure is understood to be a spring coil in which the various turns defining the first helix are in contact with adjacent turns.

There are many processes which may be utilized to manufacture the terminals of the present invention, and this invention may be readily adapted to automated manufacturing processes. For example, in one methodology, the contact spring may be first cut to an appropriate, predetermined length. The spring is then wound upon an insertion mandrel or other tool, inserted into the contact body, and allowed to unwind therein so as to contact, and be retained by, the walls of the contact member. As noted herein, the coil may be variously retained in the contact member after insertion.

Figure 3:
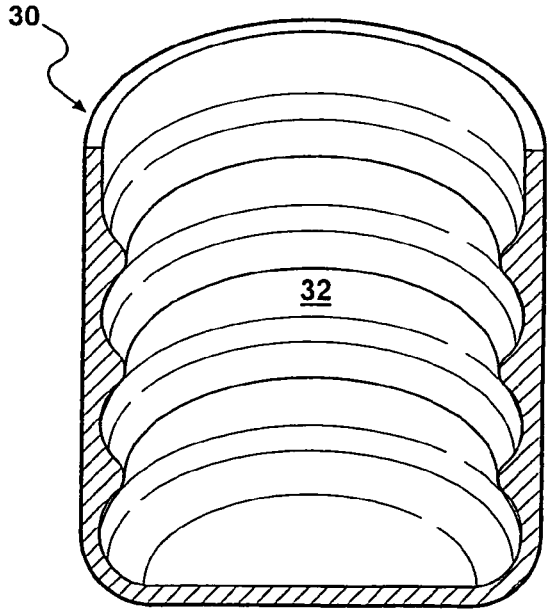
FIG. 3 is a cross-sectional view of a contact body which may be used in some embodiments of the invention.

Referring now to FIG. 3, there is shown another embodiment of contact body 30 which may be utilized in the present invention. The contact body 30 of FIG. 3 is shown in cross-sectional view and as will be seen, it is generally similar to the contact body 12 of FIG. 2 except that it includes a spiral groove 32 formed therein. This groove 32 has a diameter and pitch corresponding to the diameter and pitch of a contact spring which will be disposed within the contact body 30.

Figure 4:
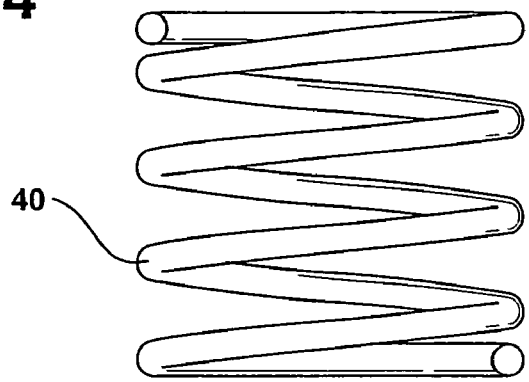
FIG. 4 is a depiction of one particular retention member which may be used in the present invention.

In some instances, a retention member may be used to aid in retaining the contact spring in the contact body. The retention member may further assist in biasing the contact spring into electrical contact with the contact body. In some instances, the retainer member itself may comprise a spring. For example, FIG. 4 shows one retainer 40 configured as a coil spring. The diameter and pitch of the retainer spring 40 of FIG. 4 corresponds to the diameter and pitch of the contact spring with which it is used. In a typical application, the contact spring 40 is made to have a diameter which is slightly oversized, and in that manner, it will serve to maintain a biasing force urging the contact spring against the contact body thereby enhancing electrical communication.

Figure 5:
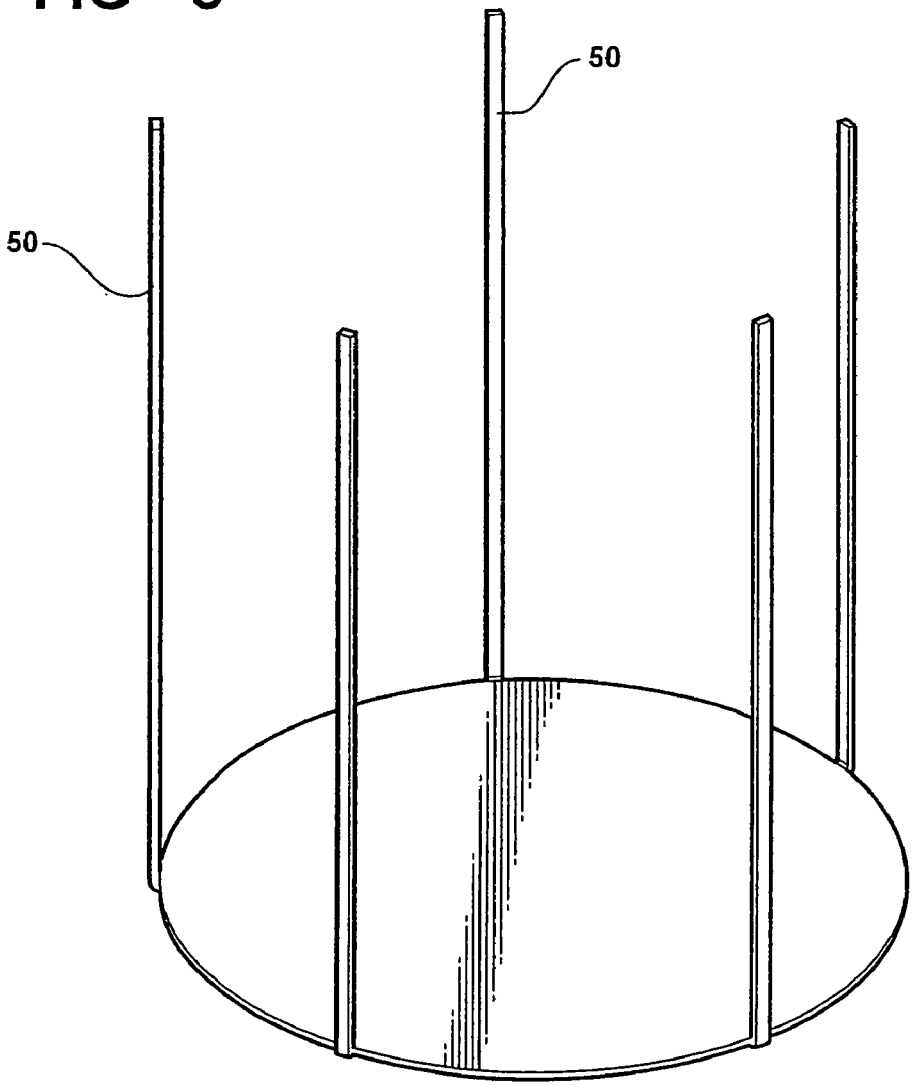
FIG. 5 is a depiction of another particular retention member which may be used in the present invention.

The retainer member may be otherwise configured. For example, FIG. 5 shows a retainer configured as an insert member having a plurality of spring blades or pins 50 projecting therefrom. The blades or pins 50 of this insert member will fit between both the primary and secondary coils of the contact spring, and will function to retain the contact spring in the contact body, and can also operate to exert a biasing force thereupon. As will be appreciated by those of skill in the art, yet other configurations of retaining member may be implemented in this invention. Also, it should be noted that the retaining member need not be electrically conductive.

In some instances, a further body of contact-enhancing material may be incorporated into the connector. For example, a body of electrically conductive mesh, fiber, felt or wool may be interposed between the contact spring and contact body and/or between the contact spring and corresponding male terminal. In certain high current applications, the connector itself may be cooled by incorporating gas flow passages therethrough. In other instances, the connector may be configured to allow for its operation in conjunction with a dielectric and/or cooling fluid.

In a specific embodiment of the invention, the connectors of the present invention may be used to establish electrical contact with a post-type battery terminal. In such embodiment, the terminal may be configured to fit onto the post. In another embodiment, the terminal may be configured to engage a male terminal which is comprised of a plurality of separate conductors, such as in a cable; in such instance, the plurality of strands comprising the cable may be directed into the terminal of the present invention, as for example by a funnel-shaped member which may be a part of the contact body itself, or a separate member. In yet other instances a funnel-shaped member may be used to gather together a grouping of cable strands, and to direct those strands to a crimpable connector associated with the terminal of the present invention.

In yet other embodiments of the present invention, the connector may be part of an array configured to allow for multiple connections thereto. In further embodiments, the connector of the present invention may be configured to provide sliding electrical contact. For example, the terminal may be configured as a cylindrical sleeve which engages a portion of the length of a rod passing therethrough, so as to provide electrical contact with the rod.

In yet other embodiments of the invention, the contact spring may be configured as a series of loops, other than the loops of a helix. For example, the spring may be configured as a plurality of discrete toroids stacked to form an opening which receives a contact pin. These discrete toroidal loops may be disposed, for example in a cylindrical contact body and retained therein in a manner similar to that described above with regard to the helical structure. Other looped structures, such as a serpentine structure, may similarly be employed.

The principles of the present invention can also be extended to non-electrical applications. For example, the sliding connector thereabove can be adapted as a detent member for linear shift mechanisms and the like.

In view of the teaching presented herein, numerous modifications and variations of the invention will be apparent to those of skill in the art. The foregoing drawings, discussion and description are illustrative of specific embodiments of the invention, but are not meant to be limitations upon the practice thereof. It is the following claims, including all equivalents, which define the scope of the invention.

The invention claimed is:

1. A female electrical terminal, said terminal comprising:

a contact body, said contact body at least partially bounding an interior volume; and a double coiled contact spring, said contact spring consisting essentially of a single, monolithic body of an electrically conductive material which is configured as a double coiled member in which the single, monolithic body of electrically conductive material is wound into a first coil so as to define a first, hollow centered helix, said first helix having a central axis, and said first helix is wound into a corkscrew configuration so that the central axis of the first helix defines a second hollow centered helix; said double coiled contact spring being at least partially disposed within the interior volume in electrical communication with said contact body.

2. The electrical terminal of claim 1, wherein said second helix defines a volume configured to receive a male terminal member.

3. The terminal of claim 1, wherein said contact body is fabricated from a metal.

4. The terminal of claim 1, wherein said contact spring is fabricated from a wire having a diameter in the range of 1-5 mil.

5. The terminal of claim 1, wherein the first helix defined by said contact spring has a diameter of approximately 0.05 inch.

6. The terminal of claim 1, wherein the contact body is a cylindrical body having a diameter of approximately 0.2 inch.

7. The terminal of claim 1, further including a male pin engageable therewith.

8. The terminal of claim 1, wherein the first coil is a closed coil.

9. The terminal of claim 1, wherein said contact spring is fabricated from a metal.

10. The terminal of claim 9, wherein said metal is an alloy of copper.

11. The electrical terminal of claim 1, further including a retainer which maintains the spring in contact with the contact body.

12. The terminal of claim 11, wherein said retainer comprises a spring member.

13. The terminal of claim 12, wherein said retainer is a coil spring.

14. The terminal of claim 12, wherein said retainer is a leaf spring.

* * * * *